United States Patent [19]

Lundh

[11] Patent Number: 4,541,508

[45] Date of Patent: Sep. 17, 1985

[54] FOLDABLE OR RETRACTABLE LADDER FOR MOUNTING IN A CEILING

[76] Inventor: Jöran Lundh, Box 461, Karlstad, Sweden, S-651 07

[21] Appl. No.: 518,310

[22] PCT Filed: Nov. 1, 1982

[86] PCT No.: PCT/SE82/00360

§ 371 Date: Jun. 22, 1983

§ 102(e) Date: Jun. 22, 1983

[87] PCT Pub. No.: WO83/01638

PCT Pub. Date: May 11, 1983

[30] Foreign Application Priority Data

Nov. 3, 1981 [SE] Sweden ..... 8106488

[51] Int. Cl.[4] ..... E04F 11/04

[52] U.S. Cl. ..... 182/178

[58] Field of Search ..... 182/77–81; 49/340

[56] References Cited

U.S. PATENT DOCUMENTS

| | | | |
|---|---|---|---|
| 476,409 | 6/1892 | Rawlings | 182/81 |
| 2,303,033 | 11/1942 | Elliott | 49/340 |
| 2,572,281 | 10/1951 | Pierce | 182/78 |
| 4,281,743 | 8/1981 | Fuller | 182/78 |

FOREIGN PATENT DOCUMENTS

| | | | |
|---|---|---|---|
| 2420178 | 11/1975 | Fed. Rep. of Germany | 182/78 |
| 1211091 | 3/1960 | France | 49/340 |
| 848926 | 9/1960 | United Kingdom | 182/79 |
| 2037717 | 7/1980 | United Kingdom | 182/81 |

*Primary Examiner*—Reinaldo P. Machado
*Assistant Examiner*—Alvin Chin-Shue
*Attorney, Agent, or Firm*—Cushman, Darby & Cushman

[57] ABSTRACT

The invention relates to a foldable or retractable ladder, especially for use at an opening in the ceiling, for example, to an upper story such as an attic in a building or the like, which ladder comprises a plurality of sections (11,12,13) arranged in operative position of the ladder, in such a manner, that the upper section (13) of the ladder by hinge members (15) is pivotally attached to a frame (14) for the door opening, and the folding-down movement of the ladder is limited by a toggle joint arrangement (16, 17) attached to the upper section (13) of the ladder. The toggle joint arrangement consists of two toggle joints attached to each side of the frame and, respectively, each side rail of the ladder and interconnected at the ladder by means of an axle (18) extending in parallel with the runs.

3 Claims, 3 Drawing Figures

FOLDABLE OR RETRACTABLE LADDER FOR MOUNTING IN A CEILING

This invention relates to a foldable or retractable ladder, for use especially at a door provided at an opening in a ceiling, for example to an upper storey such as an attic in a building or the like, which ladder comprises a plurality of sections arranged one after the other in the operational position of the ladder.

It is previously known, for example through the Laid-Out Document Sweden No. 338 663 to provide a ladder of the aforesaid kind in an opening in a ceiling, which opening is closed by a door, on which the upper section of the ladder is mounted. The door in its turn is mounted pivotally by means of hinges on a frame, which is rigidly attached in the ceiling and constitutes the opening proper. This kind of door easily gets warped, due to the fact that in addition to the weight of the door also the weight of the ladder rests on the hinge joints between door and frame, which gives rise to sealing problems.

The present invention has the object to provide a ladder, by which the aforesaid disadvantage can be prevented.

This object has been achieved in that the invention has been given the characterizing features defined in the attached claims.

Figure 1:
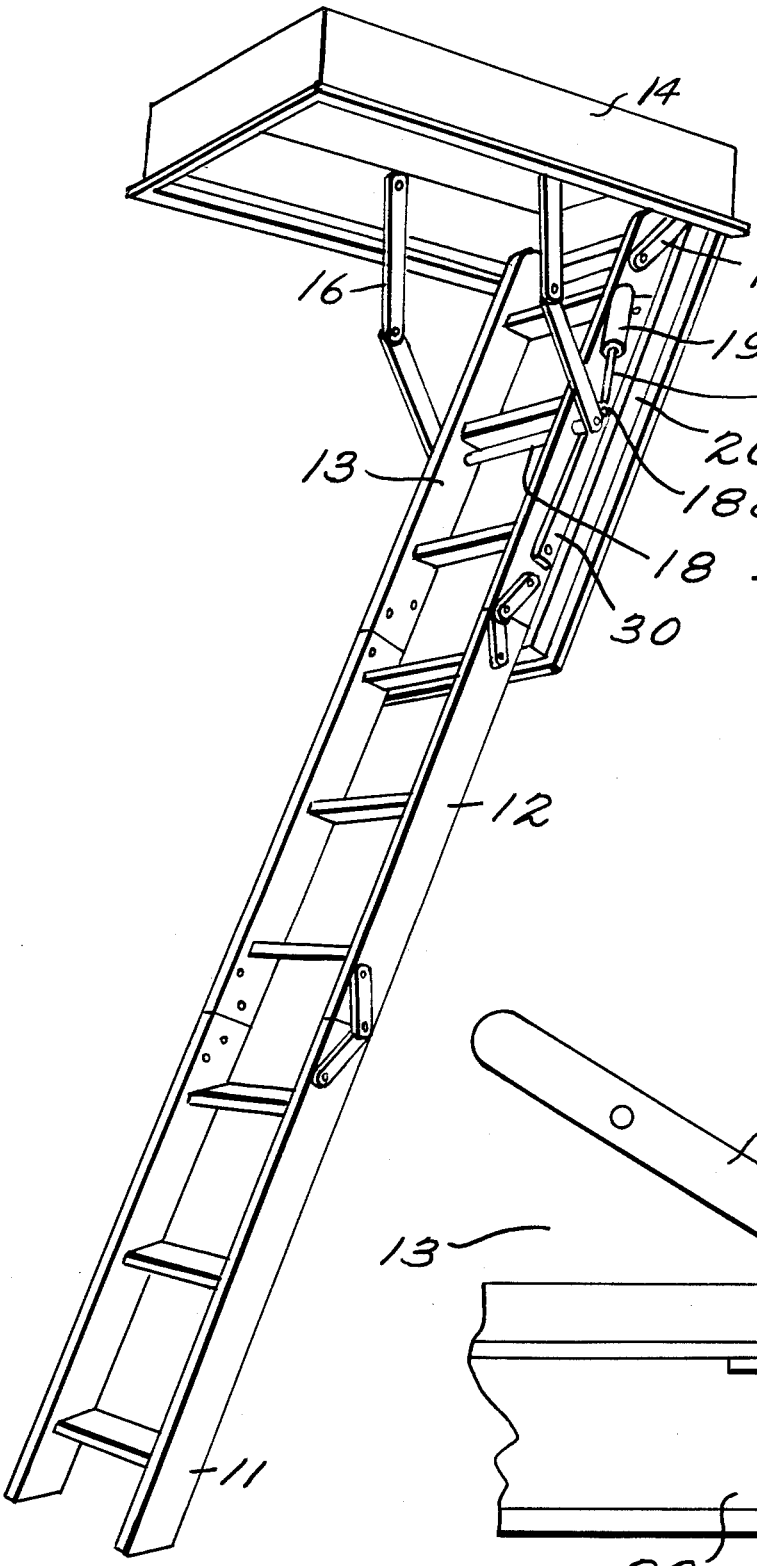
Figure 2:
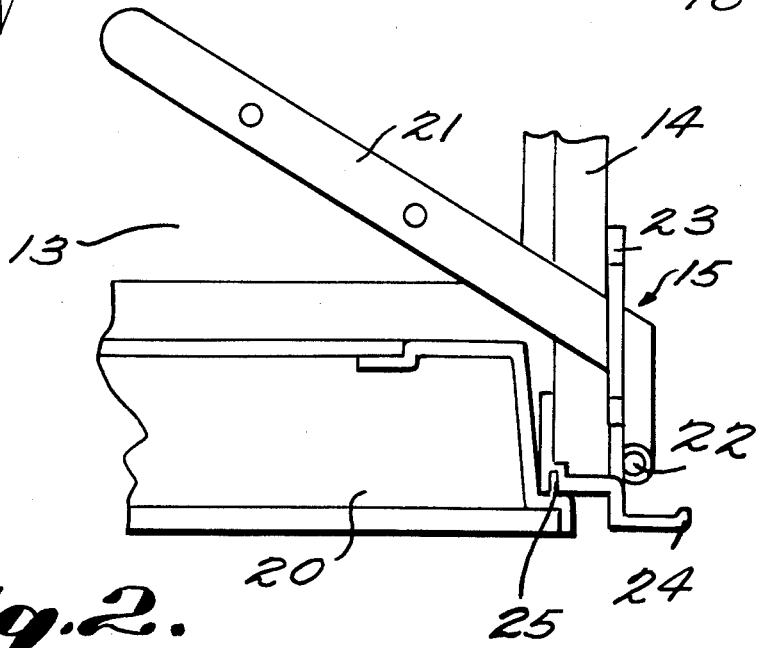

The invention is described in greater detail by way of an embodiment shown in the drawing, in which FIG. 1 shows a foldable ladder located in a door opening according to the invention, and FIG. 2 shows a hinge for the ladder according to the invention.

Figure 3:
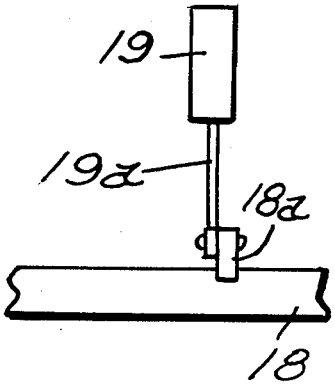

FIG. 3 is a fragmentary schematic view of a portion of FIG. 1.

In FIG. 1, thus, the foldable ladder is shown to consist of three sections, viz. the lower section 11, the central section 12 and the upper section 13. The central section 12 is hingedly connected to the two remaining sections 11,13, for example by hinge means, so that the central section 12 and the lower section 11 can be folded up on the upper section 13. The said upper section 13 is hingedly attached to a frame 14, which constitutes the door opening proper, by means of hinges 15. The folding down movement of the upper ladder section 13 is limited by a pair of toggle joints 16,17, which are attached to the upper ladder section and to the frame 14. The two toggle joints 16,17 are rigidly connected to each other at the lower arms by means of an axle 18 extending in parallel with the rungs of the ladder and are attached to said axle outside the side rails of the ladder. The ladder is spring-loaded in the direction to its closed position by means of a gas spring 19, which at one end is attached to the outside of one side rail. At its other end the gas spring 19 includes a piston rod 19*a* which is connected to a moment arm 18*a*, which is rigidly connected to the axle 18 and at such an angle in relation to said axle and to the lower arms of the toggle joints 16,17 that a maximum moment is obtained when the door is almost entirely closed. The axle 18 transfers the spring force to the two toggle joints 16,17, so that only one spring 19 is required. To the upper section 13 of the ladder also a door 20 is attached by means of flanges 30 carried by the door. When the point of connection between the gas spring 19 and the moment arm 18*a* has passed the line for moment centre, i.e. the connecting line between the attachment of the gas spring 19 to the ladder 13 and the axle 18, which passing takes place when the door is opened entirely, the gas spring 19 actuates the door so that it is locked in folded-down position, which is necessary because the "weight" of the door decreases as soon as the ladder 11–13 is folded out. Otherwise the gas spring 19 would actuate the door to return to closed position.

FIG. 2 shows how the hinge 15 is disposed when the ladder is folded up and the door 20 is closed. The hinge 15 comprises an angular leg 21, which extends through a slit in the frame 14 and is attached to the upper section 13 of the ladder. The leg 21 is connected, at a joint 22 located on the outside of the frame 14, to a plate 23, which is attached to the outside of the frame. The frame 14, for example, may consist of a particle board and on its downward facing edge is provided with a profiled lining strip 24, preferably of plastic. Hereby a completely concealed hinge mounting is obtained. The lining strip 24 has a groove 25 for receiving a sealing strip (not shown), which seals between the door 20 and frame 14. By the design according to the invention, a very stable suspension of the ladder is obtained where there is small risk that the ladder and door will warp relative to the frame. Furthermore, thermal bridges are prevented, because the hinge members are located entirely above the door and are completely concealed. Due to the design of the hinge members, the door at the beginning of an opening movement moves straight vertically downward, so that normal sealing strips can be used between the door and frame without risk that the strips will be destroyed by wear.

Instead of a foldable ladder it also is possible to imagine a retractable ladder, in which case the hinge member is attached on the outside of the frame, in precisely the same manner as for the foldable ladder, and at the upper part of the retractable ladder. It also is imaginable that the ladder is not attached directly to the hinge member, but that the hinge member is attached to the door, as also the toggle joint arrangement and the gas spring, and the ladder in its turn is attached to the door.

I claim:

1. A foldable or retractable ladder, especially for use at a door for an opening in the ceiling, for example, to an upper storey such as an attic in a building or the like, which ladder comprises a plurality of sections (11,12,13) arranged one after the other in the operative position of the ladder, which upper section (13) of the ladder is pivotally attached to a frame (14) for the door opening, and the downward pivotal movement of the ladder (11,12,13) is limited by toggle joint means (16,17) attached on the upper section (13) of the ladder as well as on the frame (14), characterized in that the toggle joint means comprise two toggle joints (16,17) attached to each side of the frame and, respectively, to each side rail of the ladder, which toggle joints are connected to each other at the ladder by means of an axle (18) extending in parallel with the rungs of the ladder, said toggle joints having lower arms rigidly interconnected by means of the axle, said ladder being spring-loaded in the direction to its closed position by means of a gas spring (19), one end of which is attached to the ladder (13) or door (20), and the other end of which is attached to a moment arm (18*a*), which is rigidly connected to the axle (18) connecting the lower arms of the toggle joints (16,17).

2. A ladder as defined in claim 1, characterized in that the point of connection between the gas spring (19) and moment arm (18*a*) when the ladder (11–13) is in its folded-down position is located below the connecting line between the attachment of the spring to the ladder

(13) and the axle (18), whereby the ladder is locked in this position.

3. A ladder as defined in claim 1, characterized in that the upper section (13) of the ladder is attached to the frame (14), and further including a door (20) having a side facing to the ladder (13) provided with flanges (30), by which the door (20) is attached to the ladder (13).

* * * * *